United States Patent [19]

Brink

[11] 4,206,847

[45] Jun. 10, 1980

[54] CLOTHES-HORSE

[75] Inventor: Fredericus J. Brink, Veenedaal, Netherlands

[73] Assignee: Ingenieursbureau Het Noorden B.V., Groningen, Netherlands

[21] Appl. No.: 932,984

[22] Filed: Aug. 11, 1978

[30] Foreign Application Priority Data

Aug. 19, 1977 [NL] Netherlands ..... 7709181

[51] Int. Cl.[2] ..... D06F 57/04

[52] U.S. Cl. ..... 211/1.3; 211/197

[58] Field of Search ..... 211/1.3, 119.01, 195, 211/196, 197

[56] References Cited

U.S. PATENT DOCUMENTS

| | | | |
|---|---|---|---|
| 882,960 | 3/1908 | Peterson | 211/197 |
| 984,591 | 2/1911 | Nelson | 211/196 |
| 1,969,821 | 8/1934 | Saxon et al. | 211/197 X |
| 2,503,386 | 4/1950 | Griffin | 211/197 |
| 2,616,570 | 11/1952 | Griffin | 211/197 X |
| 2,784,848 | 3/1957 | Senne | 211/196 |

FOREIGN PATENT DOCUMENTS

| | | | |
|---|---|---|---|
| 145654 | 3/1952 | Australia | 211/196 |
| 1128391 | 4/1962 | Fed. Rep. of Germany | 211/196 |

*Primary Examiner*—Thomas J. Holko

*Attorney, Agent, or Firm*—Pollock, Vande Sande & Priddy

[57] ABSTRACT

A clothes-horse, consisting of a standard having at its top at least three separate side arms extending therefrom at mutually substantially equal angles, between which clothes-lines are stretched, wherein the base of the standard is fastened in a socket open at its top and comprises a plurality of telescoping parts including a base member fastened to and of lesser height than the socket, the uppermost telescoping member of the standard carries a lid-like member which is larger than the opening of the socket and is in bearing connection with the extremities of the side arms, which latter consist of two substantially identical, mutually hinged parts, the inner part of which is hingedly connected substantially at its center to an auxiliary arm having a length substantially equal to one-half the length of the parts of the side arms, the auxiliary arms at their other ends being hingedly connected to the second uppermost telescoping part of the standard above the inner ends of the side arms, said inner ends being adjacent to and slidable over the standard.

3 Claims, 3 Drawing Figures

CLOTHES-HORSE

The invention relates to a clothes-horse consisting of a standard having at its top at least three separate side arms at mutually substantially equal angles, between which clothes-lines are stretched. Such a clothes-horse, which, in comparison with its total thread or line length, keeps this thread or line within a relatively small area and nevertheless can accommodate rather a lot of articles for drying and/or hanging out, is generally mounted with the base of the standard in the ground or in a socket in or on the ground. This normally causes the clothes-horse either to be left when not in use, and thus to detract from the appearance of, e.g., a garden, or to be stored, e.g., in a barn or garage, where it becomes an inconvenient obstacle. If the standard is telescoping and its side arms foldable, either the clothes-lines must be removed, at considerable effort, or the lines remain attached to the arms and are subject to tangling.

The invention overcomes these drawbacks by providing that the base of the standard is fastened in a socket open at its top and comprises a telescoping part of lesser height than the socket, as well as a plurality of other telescoping parts, the uppermost of which carries a lid-like member larger than the opening of the socket and in bearing connection with the extremities of the side arms. Each set of side arms comprises two substantially identical, mutually hinged parts, the inner of which is hingedly connected substantially at its center to an auxiliary arm substantially one-half as long as the parts of the side arms, the said auxiliary arms at their other ends being hingedly connected to the second uppermost telescoping part of the standard over the inner ends of the side-arms, said inner ends being jointly slidable over the standard.

According to the invention the said inner ends of the side arms can be hingedly connected to a securable sliding or bearing ring, which can slide over the standard and is connected to the lid, optionally to the top of the uppermost telescoping part of the standard. These inner ends can also slide in grooves in the standard or can be secured thereto by pins or snaps.

According to the invention the uppermost telescoping part of the standard may comprise a member which, upon automatic lowering of the lid, releases the snaps of the telescoping parts, so that these latter are lowered in or about each other. Of course, the release of the snaps can also be accomplished manually.

According to the invention, the connection between the lid and the extremities of the side arms may comprise an umbrella, which can shelter the hung out clothes against precipitation. This unbrella-like member can extend beyond the extremities of the side arms and thus offer even greater protection.

The invention is illustrated by the accompanying drawings, showing two embodiments of the clothes-horse according to the invention, as well as a diagram of its operation. In the drawing.

Figure 2:
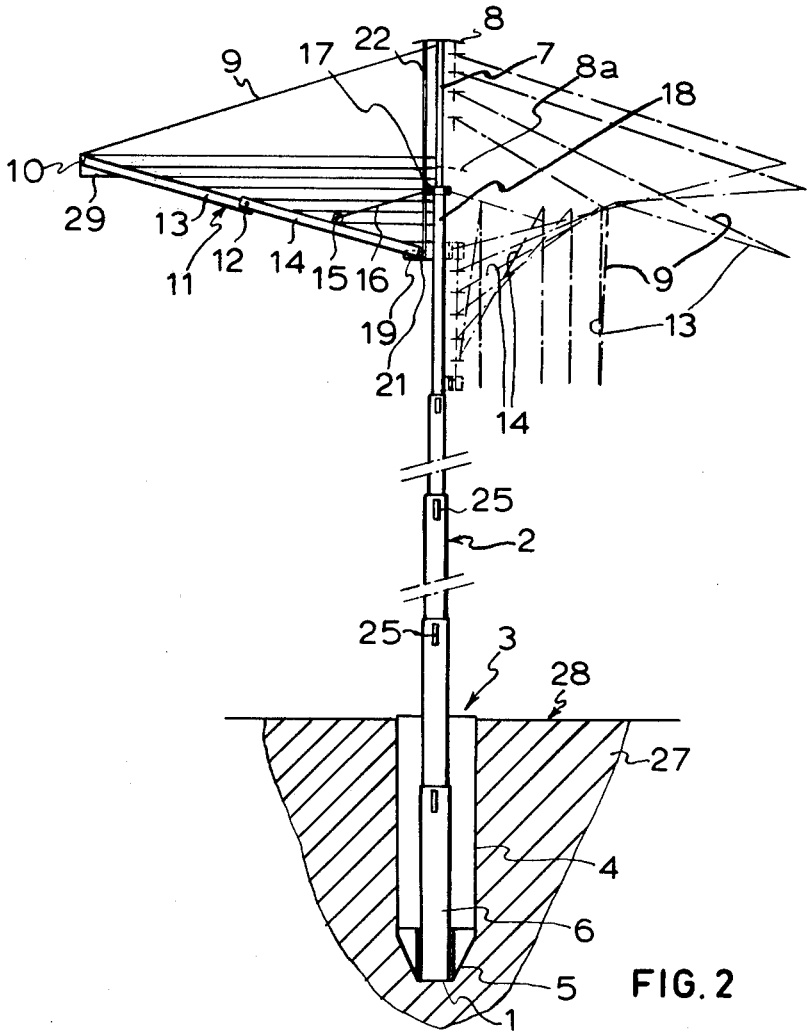
FIG. 2 shows at the left half a diagrammatic side view of the clothes-horse, and at the right its operation in outline.

FIG. 2 shows a standard 2, base 1 of which is mounted through a locking stay 5 in or welded or otherwise connected to a socket 4, which is embedded in the ground 27 and the top opening 3 of which protrudes a little above the ground surface 28 in order to prevent the entry of water. The bottom side of the socket 4 preferably contains a few apertures, and preferably gravel or the like is applied under the socket 4 in order to dispose of any water accumulations. The length of the lowermost telescoping part 6 of the standard 2 is less than that of the socket 4. The uppermost telescoping part 7 carries a lid-like member 8, which is in connection 9 with the extremities 10 of the side arms 11 directly or through the top of part 7. These connections 9 may be strings or threads, but preferably they are formed by an umbrella-like member covering the whole structure. This member preferably has a portion 29 overhanging the extremities 10 of side arms 11 for better protection against precipitation.

Figure 1:
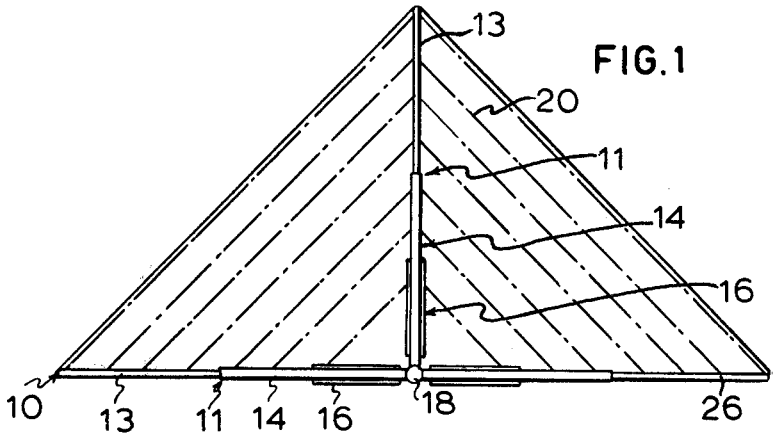
FIG. 1 shows a partial top view of the clothes-horse.

The side arms 11 with pins 26 for the clothes lines 20 (FIG. 1) comprise two parts 13 and 14 of substantially equal length, hingedly connected at 12 in such a way that part 13 cannot be folded upward, by means of spring 30, beyond its illustrated position forming an extension of part 14. The radially inner part 14 is hingedly connected at 15 to an auxiliary arm 16, which in turn is hingedly connected at its other extremity at 17 to the second telescoping part 18 of standard 2. The inner ends 19 of the side arms 11 in this example are hingedly connected to a sliding or bearing ring 21, which through one or more thin rods 22 is connected to the lid 8. The telescoping parts, such as 6, 7 and 18, are conventionally connected to each other through snaps 25.

In order to store the structure in socket 4, the uppermost telescoping part 7 of the standard 2 is lowered. This causes bearing ring 21 also to be lowered. As the inner parts 14 of the side arms are held by their auxiliary arms 16, the hinge joints 12 between the side arm parts 13 and 14 move inwardly, while the extremities 10 of the side-arms 11 move inwardly as well as downwardly. As soon as the lid 8 comes to rest on the upper edge of the second telescoping part 18 of the standard 2, which is indicated in dotted line 8*a*, the arms 11 and 16, the clothes-lines and optionally the umbrella 9 or the strings or threads 9 are folded to the standard 2. By subsequently lowering the other telescoping parts of the standard 2 successively in or about each other, the whole structure is caused to sink into the socket 4 and same is then closed by the lid 8.

Figure 3:
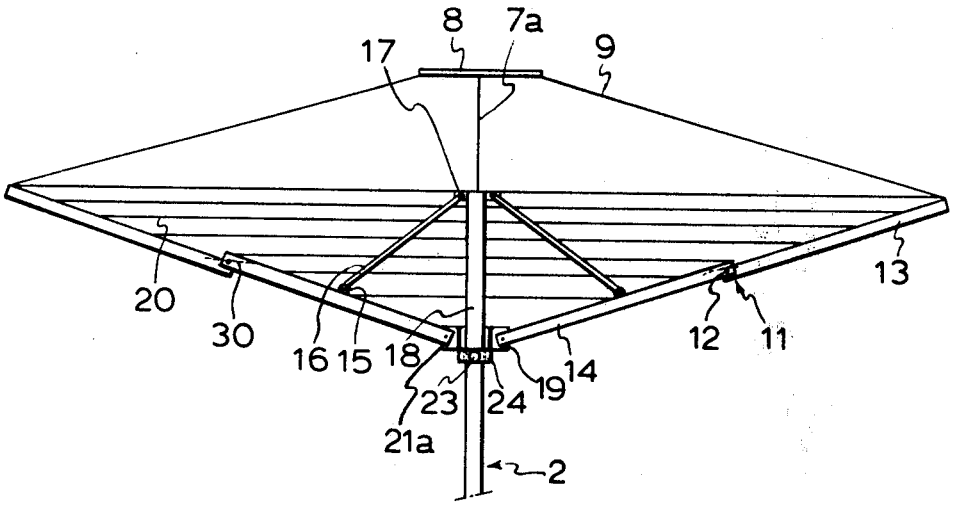
FIG. 3 shows an embodiment with a collar and a member automatically releasing the snaps.

FIG. 3 embodies a few variants of the upper part of the clothes-horse according to the invention. First of all, the telescoping uppermost part of the standard 2 is constructed as a pin 7*a* positioned under the lid 8. The ring 21*a* in this embodiment is borne by a locking collar 24 securable by a pin 23. This collar and the auxiliary arms 16 keep the lid at its required level above the locking collar 24. As soon as this collar 24 is released, the extremities 19 of the side arms 11 as well as the lid 8 sink in the manner described. The sinking motion is illustrated in the right-hand part of FIG. 2.

The fastening of the inner ends 19 of the side arms 11 can also be effected by pins or snaps instead of by a ring 21*a*.

Storage of the clothes horse, out of sight and out of the way, can take place very fast quickly, as can its erection, which of course takes place in reverse sequence. There is no need for dismantling, and the clothes-lines 20 sink automatically into the socket 4 without any chance of knotting. If more than four side arms 11 are employed, the clothes-line sections between these side arms 11 become even shorter and more readily storable in the sleeve 4.

What is claimed is:

1. A clothes drier, comprising (a) a standard comprising a plurality of telescoping members;

(b) a socket for said standard, having an opening at the top thereof, the lowermost one of said telescoping members being attached to and fully contained within said socket;

(c) at least three side arms extending from the upper portion of said standard at substantially equal angles from one another and having clothes-lines extending therebetween, each of said side arms comprising a radially inner part and a radially outer part, said inner and outer parts being substantially identical and hinged to one another;

(d) an auxiliary arm hingedly connected to one end to each said inner part at substantially the center thereof and at its other end to the second uppermost one of said telescoping member above the inner ends of said inner parts, each said auxiliary arm having a length substantially one-half the length of said parts of said side arms, said inner ends of said inner parts being adjacent to and slidable over said standard; and (e) a lid member attached to the uppermost one of said telescoping member, said lid member being larger than said opening in said socket and having a bearing connection with the outer ends of said outer parts of said side arms.

2. A clothes-horse according to claim 1, wherein the inner ends of the side arms are hingedly connected to a bearing ring slidable over said standard and connected to said lid member at the top of said standard through a connecting element.

3. A clothes-horse according to claim 1, wherein said inner ends of said side arms are connected to a bearing ring slidable on said standard, said bearing ring in turn resting on a locking collar secured to said standard by a pin.

* * * * *